US005136153A

United States Patent [19]

Komiya et al.

[11] Patent Number: 5,136,153

[45] Date of Patent: Aug. 4, 1992

[54] COLOR IMAGE FORMING APPARATUS HAVING IMAGE INTENSIFIER UNIT

[75] Inventors: Ryohei Komiya; Mayumi Ishikawa; Hiroshi Sumiya; Fumihiro Sunda; Yoshiyuki Ban, all of Nagoya, Japan

[73] Assignee: Brother Kogyo Kabushiki Kaisha, Nagoya, Japan

[21] Appl. No.: 557,076

[22] Filed: Jul. 25, 1990

[30] Foreign Application Priority Data

| | | | |
|---|---|---|---|
| Jul. 28, 1989 | [JP] | Japan | 1-197237 |
| Jul. 28, 1989 | [JP] | Japan | 1-197238 |
| Aug. 9, 1989 | [JP] | Japan | 1-206028 |
| Aug. 9, 1989 | [JP] | Japan | 1-206030 |
| Aug. 18, 1989 | [JP] | Japan | 1-213275 |

[51] Int. Cl.[5] ..... H01J 40/14

[52] U.S. Cl. ..... 250/213 VT; 346/110 R

[58] Field of Search ..... 250/213 VT; 358/302, 358/300, 75; 346/108, 110 R

[56] References Cited

U.S. PATENT DOCUMENTS

| | | | |
|---|---|---|---|
| 2,572,494 | 10/1951 | Krieger et al. | 250/213 VT |
| 2,594,740 | 4/1952 | De Forest et al. | 250/213 VT |
| 2,605,335 | 7/1952 | Greenwood, Jr. et al. | 250/213 VT |
| 2,871,385 | 1/1959 | Roberts | 250/213 VT |
| 3,267,283 | 8/1966 | Kapany | 250/213 VT |
| 3,809,888 | 5/1974 | Stock et al. | 250/213 |
| 4,555,731 | 11/1985 | Zinchuk | 250/213 VT |
| 4,603,250 | 7/1986 | Contini et al. | 250/213 VT |
| 4,752,823 | 6/1988 | Takahashi et al. | 358/302 |
| 5,013,902 | 5/1991 | Allard | 250/213 VT |

FOREIGN PATENT DOCUMENTS

| | | |
|---|---|---|
| 0262676 | 4/1988 | European Pat. Off. . |
| 969582 | 9/1964 | United Kingdom . |
| 999649 | 7/1965 | United Kingdom . |
| 1267103 | 3/1972 | United Kingdom . |
| 1446774 | 8/1976 | United Kingdom . |
| 1552560 | 9/1979 | United Kingdom . |
| 2034513 | 6/1980 | United Kingdom . |
| 2110465 | 6/1983 | United Kingdom . |
| 2129205 | 5/1984 | United Kingdom . |

*Primary Examiner*—David C. Nelms
*Assistant Examiner*—Que T. Le
*Attorney, Agent, or Firm*—Oliff & Berridge

[57] ABSTRACT

An image forming apparatus for irradiating an image light on a photosensitive recording medium having at least one photosensitive wavelength range on the basis of an image information to thereby form an image on the photosensitive recording medium, comprising a semiconductor laser for emitting an image light or a thermal cathode for emitting thermoelectrons having the image information, a photomultiplier or microchannel plate for converting the image light or the thermoelectrons into secondary electrons while the image forming information is kept, and multiplying the secondary electrons, and a fluorescent screen for converting the multiplied secondary electrons into an intensified image light. The intensified image light may be supplied on a photosensitive recording medium while the image forming information is kept, thereby forming an image on the photosensitive recording medium.

27 Claims, 11 Drawing Sheets

COLOR IMAGE FORMING APPARATUS HAVING IMAGE INTENSIFIER UNIT

BACKGROUND OF THE INVENTION

The present invention relates to a color image forming apparatus for forming a color image on a fluorescent screen or a photosensitive recording medium which has plural sensitivities to lights of plural wavelength ranges, and more particularly to a color image forming apparatus having an image intensifier unit for intensifying an image light to thereby form a color image having a high output power with high quality and high resolution.

In recent years, there have been known various color image forming apparatuses for forming a color image on a color-image reproducible photosensitive recording medium. With the advance of digitization of image formation, an apparatus utilizing a semiconductor laser or a light-emitting diode (LED) as a light source for producing an image light has been particularly put to practical use.

At present, semiconductor lasers can be practically used in only specific wavelength ranges, for example, from 780 to 830 nm (for CD players, laser printers, and like), or 1550 nm (for general communication systems). Further, LEDs can be practically used in only specific wavelength range of 650 nm, 750 nm or 840 nm, and hence the LEDS as well as the semiconductor lasers has severe restriction to a practically usable wavelength range. If a color image is recorded on a photosensitive recording medium using an image light which has a wavelength located in the wavelength ranges as described above, then it is necessary to develop recording medium materials having sensitivities which match with those wavelength ranges. However, some photosensitive recording media such as silver-salt photographic films and photosensitive microcapsule-coated sheets (see Japanese Unexamined Published Patent Application 58-88739 and U.S. Pat. No. 4,399,209, for example) have sensitivities which do not match with the wavelength ranges of the semiconductor lasers or the like. For example, since the spectral sensitivity of the silver-salt photographic films is in a short wavelength range of from 400 to 700 nm, no semiconductor lasers can be used for the silver-salt photographic films. Further, there is a special silver-salt photographic film having a sensitivity to light in the infrared range (for example a photographic film manufactured by Kodak). However, the cost of energy required by this silver-salt photographic film is higher since its sensitivity to light in the infrared range is lower than that in a shorter wavelength range and a higher intensity of light is needed to perform an exposure process. Similarly in the silver-salt photographic film, the semiconductor lasers can not be used for the photosensitive microcapsule-coated sheets as described above since the spectral sensitivity of the sheets is also in a short wavelength range of from 400 to 700 nm. In view of the foregoing, there has been developed semiconductor lasers which could be used for a photosensitive recording medium having a spectral sensitivity to light in such inherent wavelength range. However, the cost of energy required by such semiconductor lasers is higher because of the short wavelength range.

On the other hand, there has been also known an image forming apparatus in which a color image is recorded using as a light source for producing an image light an image display such as a cathode-ray tube (CRT), a liquid-crystal display (LCD), a light-emitting diode (LED) display, an electroluminescence (EL) display, a plasma display or the like. However, these image displays have the following disadvantages, and therefore an image forming apparatus utilizing one of these image displays has not been hitherto put to practical use.

A CRT has a luminescent screen coated with a fluorescent material for emitting on the basis of an image information an image light whose wavelength matches with the spectral sensitivity of a photosensitive recording medium. With such an arrangement, the wavelength range of the image light and the photosensitive wavelength distribution of the photosensitive recording medium can be easily matched with each other. However, in this apparatus, if an output power of the electron beam in the CRT is increased, the diameter of a beam spot cannot be reduced. As a result, no higher brightness can be achieved b/ this apparatus and the edges of recorded images are blurred. Further, the depth of the CRT itself must be increased as the CRT is designed to be larger in size, so that the volume of the CRT is increased by the third power of the length. Still further, since the internal space of the CRT is kept under vacuum condition, a thickness of a glass housing of the CRT must be increased to prevent the glass housing from exploding due to the vacuum condition. Consequently, the weight of the CRT is also increased.

Further, the LCD has a higher production cost if a TFT (thin film transistor) is employed for solving the problem of visual angle. In addition, the cost is also increased if a redundancy circuit is provided for providing a large scale display.

Still further, in case of an image display using a semiconductor technique such as LED and EL, since a light emitting efficiency at short wavelength is low, this image display is incapable of practical use. The plasma display suffers a lower light emission brightness due to degradation of the discharge gas.

SUMMARY OF THE INVENTION

The present invention has been made in an attempt to solve the aforesaid drawbacks, and it is an object of the invention to provide a color image display having a flat screen which is low in cost and small in size.

Another object of the present invention is to provide a color image forming apparatus capable of forming a color image with high output power on a photosensitive recording medium which has plural sensitivities to lights of plural inherent wavelength ranges for the development of color images.

Still another object of the present invention is to provide a color image forming apparatus capable of forming a color image having a continuous color tone.

To achieve the above objects, according to one aspect of this present invention, an image forming apparatus for irradiating an image light on a photosensitive recording medium having at least one photosensitive wavelength range on the basis of an image information to thereby form an image on the photosensitive recording medium, comprises primary electron emitting means for emitting primary electrons such as photoelectrons or thermoelectrons each having the image information, secondary electron emitting/multiplying means for converting the primary electrons into secondary electrons while the image forming information is kept and multiplying the secondary electron, and fluorescent light emitting means for converting the multiplied secondary electrons into fluorescent light having a wavelength in the photosensitive wavelength range of the photosensitive recording medium and irradiating the fluorescent light onto the photosensitive recording medium, thereby forming an image on the photosensitive recording medium.

According to another aspect of this invention, an image forming apparatus for irradiating a color image light on a photosensitive recording medium having plural photosensitive wavelength ranges on the basis of an image information to thereby form a color image on the photosensitive recording medium, comprises primary electron emitting means for emitting primary electrons such as photoelectrons and thermoelectrons each having the image information, secondary electron emitting/multiplying means for converting the primary electrons into secondary electrons and multiplying the secondary electrons, fluorescent light emitting means for converting the multiplied secondary electrons into red, green and blue color image lights having wavelengths matching with the photosensitive wavelength ranges of the photosensitive recording medium and irradiating the color image lights onto the photosensitive recording medium, thereby forming color image on the photosensitive recording medium.

The image forming apparatus thus constructed may be used as an image display having a screen on which red, green and blue fluorescent cells are provided to emit a color image.

With the color image forming apparatus according to the present invention, when the image light or the thermoelectron signal is emitted by the secondary electron emission inducing means based on the image information, the image light or the thermoelectron signal is converted into the secondary electrons, and then the secondary electrons are multiplied by the multiplying means while the multiplication (the number of the secondary electrons to be produced) is controlled by the multiplication control means. Thereafter, the speed of the secondary electrons is accelerated by the acceleration control means, and then the accelerated secondary electrons are applied to the fluorescent cells of the fluorescent light emitting means. The fluorescent cells are coated with a plurality of types of fluorescent materials having spectral sensitivity characteristics corresponding to respective photosensitive wavelength ranges of the photosensitive recording medium, i.e., a fluorescent material which emits red light with respect to red image information, a fluorescent material which emits green light with respect to green image information, and a fluorescent material which exits blue light with respect to blue image information. The multiplication control means and/or the acceleration control means are independently and separately (or individually) assigned to each of the plural types cf fluorescent cells, thereby individually changing the number or speed of the secondary electrons to be incident to each type of fluorescent cells, so that brightness of the light to be emitted from each type of the fluorescent cells is individually controlled and a color tone (gradation) of an image to be formed is continuously adjusted.

DETAILED DESCRIPTION OF THE INVENTION

Preferred embodiments of the present invention will be hereunder described with reference to the accompanying drawings.

Figure 1:
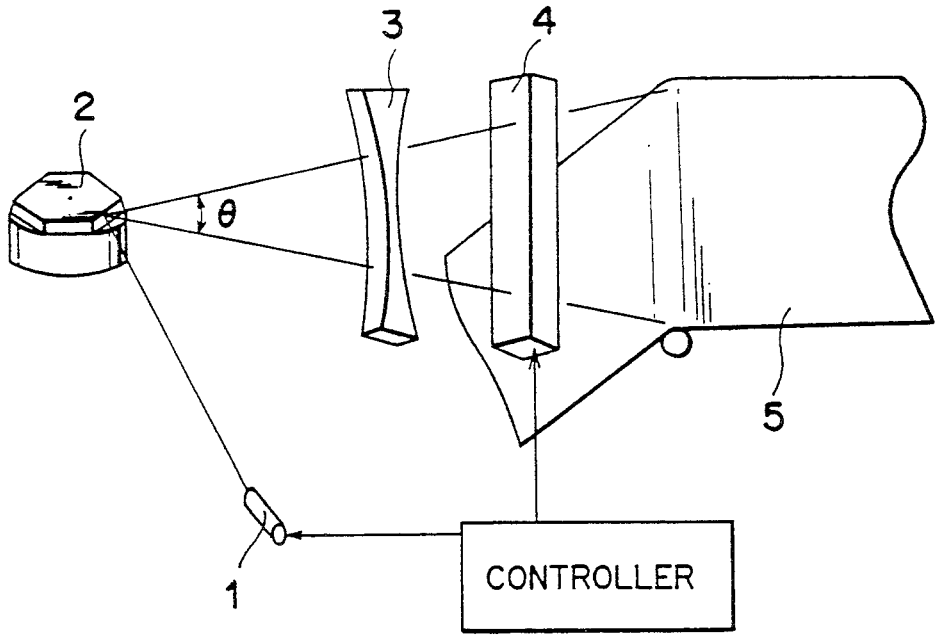
FIG. 1 is a schematic view showing an overall arrangement of a first embodiment of an image forming apparatus according to the present invention.

FIG. 1 shows an overall arrangement of an image forming apparatus according to the present invention. The image forming apparatus as shown in FIG. 1 basically comprises a light emitting device 1 such as a semiconductor laser for emitting a light beam which is modulated on the basis of an image information to obtain an image light, an optical deflecting mirror 2 such as a polygon mirror or a galvano-mirror for scanning a photosensitive recording medium with the image light incident thereto, a focusing optical unit 3, and a light intensifier unit 4 for converting the image light passed through the focusing optical unit 3 to an amplified electron signal and then converting the amplified electron signal into an intensified image light.

In the apparatus thus constructed, the image light emitted from the light emitting device 1 is deflected over an angle $\theta$ by the optical deflecting unit 2. The deflected image light is applied through the focusing optical unit 3 to the light intensifier unit 4. The intensified image light which is emitted from the light intensifier unit 4 transversely scans a photosensitive recording medium 5 which is fed in a predetermined direction.

The photosensitive recording medium 5 comprises a base sheet coated uniformly and dispersely over the surface thereof with plural kinds of photosensitive microcapsules which separately encapsulate cyan dye precursor, magenta dye precursor and yellow dye precursor, respectively. The wavelengths of lights to which the cyan, magenta, and yellow capsules are photosensitive are 650 nm, 550 nm, and 450 nm, respectively.

Figure 2:
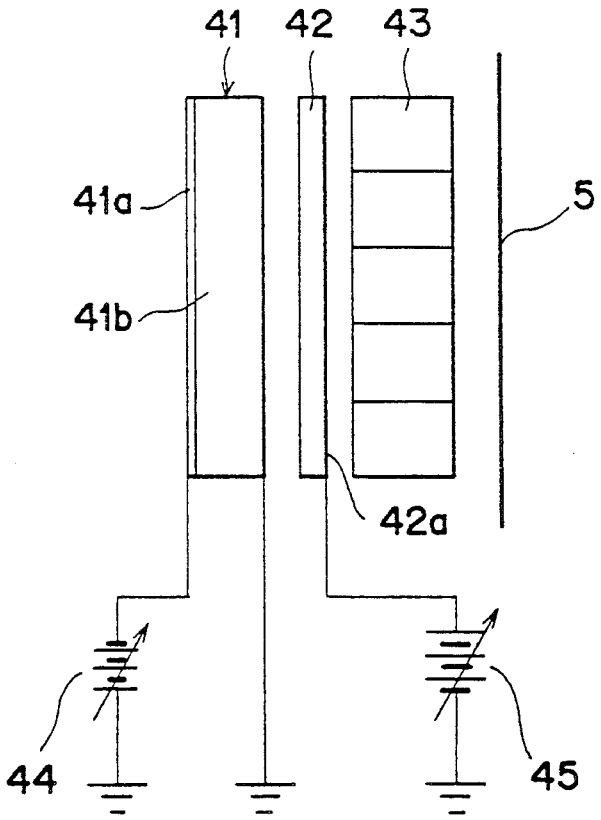
FIG. 2 is a schematic view of a photoelectric light intensifier unit 4 according to the first embodiment.

The structure of the light intensifier unit 4 is shown in FIG. 2. As shown in FIG. 2, the light intensifier unit 4 comprises a photoelectric transducer unit 41, a fluorescent panel 42 and an optical lens 43, which are juxtaposedly arranged in this order at small intervals.

Figure 3:
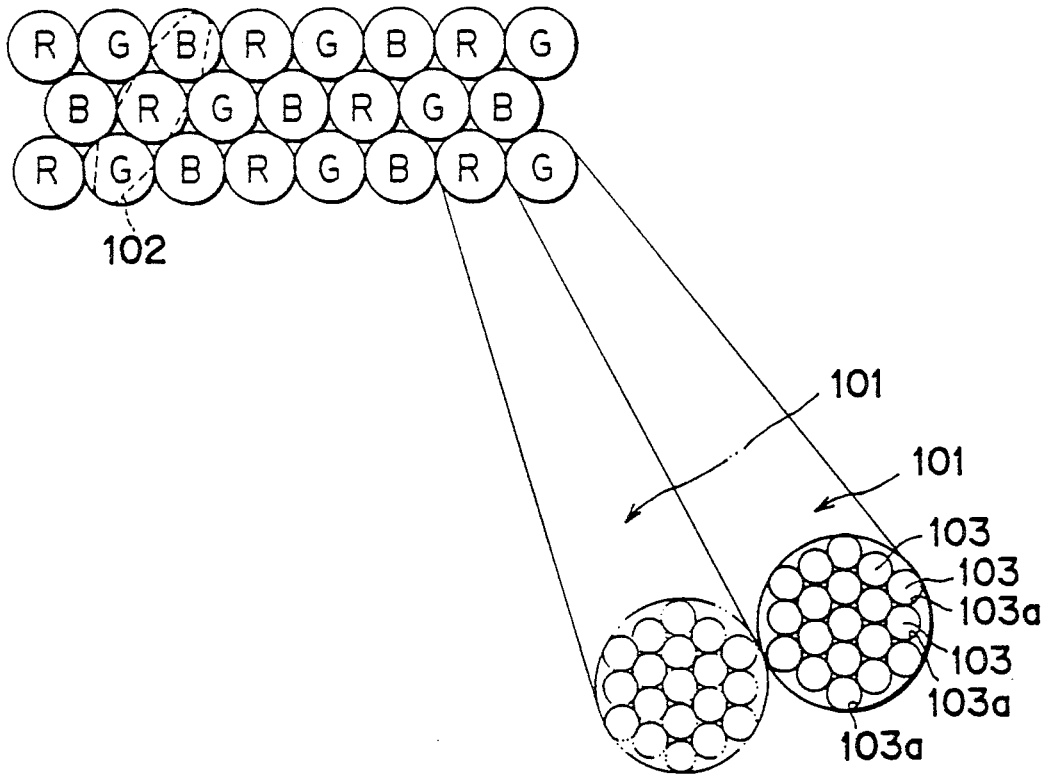
FIG. 3 is a schematic view showing the positional relationship between the microchannel plate and fluorescent cells.

The photoelectric transducer unit 41 comprises a photoelectric transducer 41*a* disposed at the light-incident side thereof for converting an incident image light into photoelectrons as primary electrons, and a photomultiplier 41*b* disposed at the light-exit side thereof for converting the photoelectrons produced by the photoelectric transducer 41*a* into secondary electrons and multiplying the secondary electrons. The photoelectric transducer 41*a* is made of a material which may be Sb-K-Na-Ca when the image light emitted from the light-emitting device 1 is in the visible range, or Ag-O-Cs when the image light emitted from the light emitting device 1 is in the near-infrared range. As shown in FIG. 3, the photomultiplier 41*b* includes clusters 101 of minute through holes 103, each of which is referred to as a channel and has a secondary electron emission layer 103*a* on the inner wall thereof. The photoelectrons produced in the photoelectric transducer 41*a* are led into the channels and impinge upon the secondary electron emission layers 103*a*, whereby secondary electrons are produced in the photomultiplier 41*b* in accordance with the incident light image. Thereafter, the secondary electrons thus produced are multiplied as they repeatedly impinge upon the secondary electron emission layers 103*a*.

As shown in FIG. 2, the light-incident side ( the photoelectric transducer 41*a*) of the photoelectric transducer unit 4 is connected to a variable-voltage supply source 44, whereas the light-exit side (the photomultiplier 41*b*) of the photoelectric transducer unit 41 is grounded. When a voltage applied by the variable voltage supply 44 is varied (decreased or increased), the number of secondary electrons to be emitted from the photoelectric transducer unit 41 can be changed (decreased or increased) several hundred thousand times through several million times.

Figure 4:
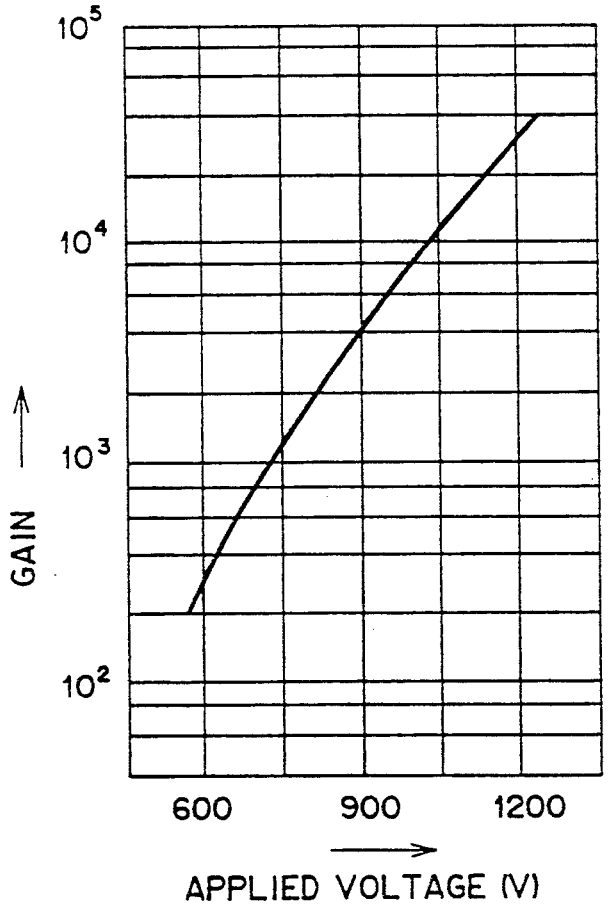
FIG. 4 is a graph representing a gain characteristic of a microchannel plate.

FIG. 4 shows a typical secondary electron multiplication characteristic indicating the relationship (gain) between an applied voltage by the variable-voltage supply source 44 and the number of secondary electrons to be produced. The photoelectric transducer unit 41 is generally called a "microchannel plate".

Figure 5:
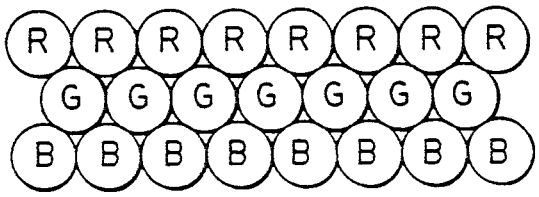
FIG. 5 is a schematic view showing a strip arrangement of fluorescent cells.

The fluorescent panel 12 has a transparent substrate 42*a* coated with fluorescent materials at the secondary electron incident side thereof. The fluorescent materials coated on the fluorescent panel 42*a* are those kinds of materials for emitting lights whose wavelengths match with the wavelengths to which the cyan, magenta and yellow capsules are sensitive. More specifically, the fluorescent materials comprises a fluorescent material (R) for emitting red light (having a wavelength of 650 nm) for the cyan capsules, a fluorescent material (G) for emitting green light (having a wavelength of 550 nm) for the magenta capsules, and a fluorescent material (B) for emitting blue light (having a wavelength cf 450 nm) for the yellow capsules. These fluorescent materials (hereinafter referred to as "fluorescent cells") are provided in a regular pattern on the surface of the fluorescent panel 42. For example, the three types of fluorescent cells R, G and B are aggregately assembled in a delta (triangular) form every three cells as shown in FIG. 5 or are parallel arrayed in a stripe form while the same kind of fluorescent cells are aligned with one another as shown in FIG. 6.

Figure 6:
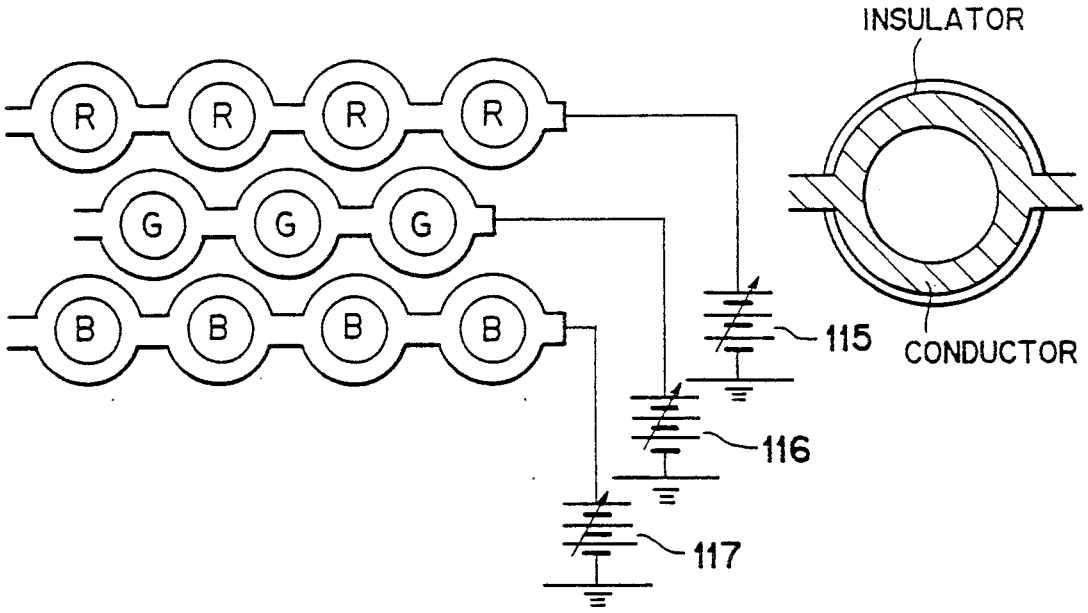
FIGS. 6 and 7 are schematic views showing arrangements of electrodes serving as electron accelerating means.
Figure 7:
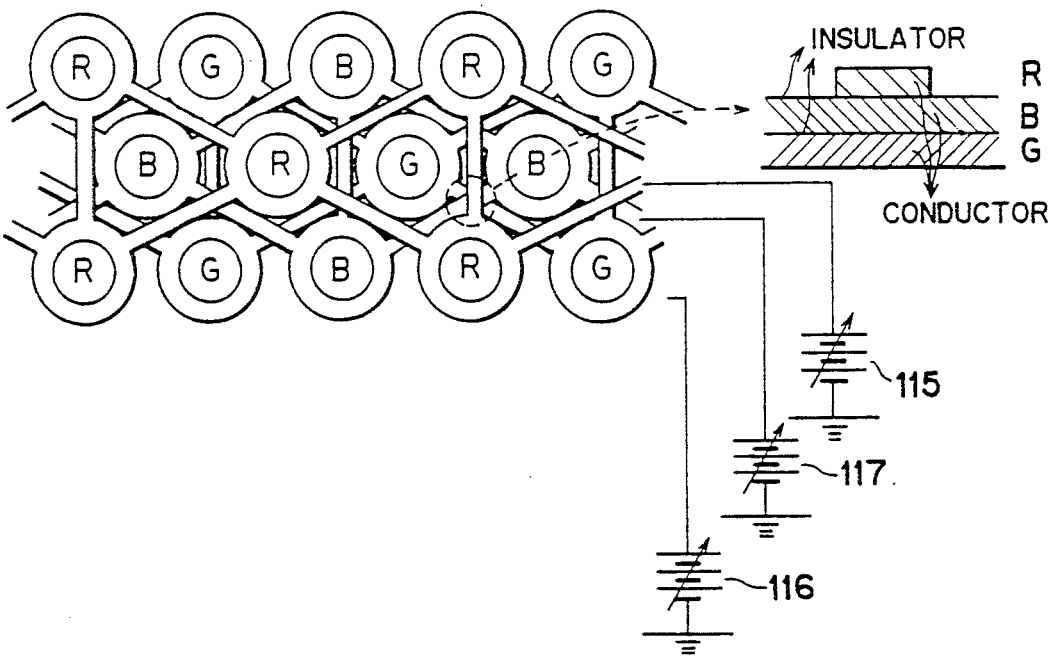

For these three types of fluorescent cells R, G and B, three types of electrodes serving as electron accelerating means are separately and independently mounted on the fluorescent panel 42, respectively, For example, the electrodes are arranged as shown in FIG. 6 for the strip arrangement of the fluorescent cells and as shown in FIG. 7 for the delta arrangement of the fluorescent cells.

The fluorescent panel 42 is connected to variable voltage supplies 45. More specifically, the electrode for the R fluorescent cells is connected to a variable-voltage supply 115, the electrode for the G fluorescent cells is connected to a variable voltage supply 116, and the electrode for the B fluorescent cells is connected to a variable-voltage supply 117. The emission of light from the fluorescent cells is controlled by adjusting the voltages to be applied from these voltage supplies 115, 116 and 117 to the electrodes on the basis of a color information of a color image to be reproduced.

As shown in FIG. 3, the light intensifier unit 4 of this embodiment is designed such that a beam spot (as shown by a dotted line) emitted from the light-emitting device 1 covers a plurality of channel clusters 101 and each of the channel clusters 101 corresponds to one fluorescent cell.

Further, the optical lens 43 comprises a rod lens array (known under the trademark; SELFOC lens) having a short focal point which is positioned in such a manner as to confront the surface of the photosensitive recording medium 5.

An operation of the color image forming apparatus thus constructed will be described hereunder.

An image light which is emitted from the light-emitting device 1 on the basis of an image information is applied through the optical deflecting unit 2 and the focusing optical unit 3 to the light intensifier unit 4. The image light is first converted into photoelectrons by the photoelectric transducer 41*a* of the photoelectric transducer unit 41, and then the photoelectrons produce secondary electrons while multiplying the secondary electrons several hundred thousand times through several million times. Thereafter, the multiplied secondary electrons are applied to corresponding fluorescent cells of the fluorescent panel 42, so that color image lights R, G and B are emitted from the corresponding fluorescent cells. Three types of color image lights (R, G and B) emitted from those fluorescent cells are applied through the optical lens 43 to corresponding positions on the photosensitive recording medium 5.

In this embodiment, the light-emitting device 1 simultaneously produces three color informations of red, green and blue, thereby enabling the R, G, B fluorescent cells to simultaneously emit three color image lights. Prescribed portions on the recording medium are exposed to the color image lights emitted from the respective fluorescent cells, and a latent image corresponding to the color image is formed on the recording medium. In order to perform a control on the basis of the color informations of the color image, there are employed secondary electron acceleration control means which are separately provided to the respective types of fluorescent cells.

A developing process of the latent image on the photosensitive recording medium is performed by a well known process in which the photosensitive recording medium having the latent image thereon is superposed on a desired color developer sheet under pressure, to thereby develop the latent image on the photosensitive recording medium into a visible color image on the color developer sheet.

In this embodiment, a semiconductor laser is employed as the light-emitting device for emitting an image light, however, the light-emitting device is not limited to the semiconductor laser. For example, LED arrays, EL arrays or the like may be used as the light emitting device.

Further, the photosensitive recording medium may be any one of various color-reproducible recording mediums such as a silver-salt photosensitive film in place of the photosensitive microcapsule-coater sheet.

Still further, the shape of each of the R, G, B fluorescent cells may be of a polygonal shape (for example, a triangular shape). Such an arrangement eliminates gaps which would otherwise be present between the fluorescent cells, thereby improving an image quality of the recorded image.

In the above embodiment, plural types of electrodes each serving as electron acceleration control means are provided on the surface of the fluorescent plate 42 to reproduce a color image having a color tone. In other words, the color tone of the image to be reproduced is adjusted by independently and separately (or individually) changing voltages to be applied to the R, G and B fluorescent cells, respectively, thereby to control the acceleration of secondary electrons incident to each of the R, G and B fluorescent cells. However, a manner of adjusting the color tone is not limited to this manner.

The color tone can be also adjusted by independently and separately (or individually) controlling multiplication (the number) of secondary electrons to be emitted in the photoelectric transducer unit 41. For example, in place of or in addition to the electrodes as shown in FIGS. 6 and 7, plural types of electrodes having various arrangements, for example, as shown in FIG. 6 or 7, are provided as secondary electron multiplication control means to the photoelectric transducer unit 41 in such a manner as to be independently and separately (or individually) assigned to the three types of channels which correspond to the R, G and B fluorescent cells, respectively. The electrodes, for example, may be provided at the light-incident surface of the photoelectric transducer element 41 (photoelectric transducer 41*b*), In this case, like the electrodes as shown in FIGS. 6 and 7, the respective electrodes for the R, G and B fluorescent cells are connected to respective variable voltage supply sources (corresponding to the variable voltage supply source 44 as shown in FIG. 2) and the voltages applied thereto are independently and separately changed, so that the multiplication of secondary electrons (the number of secondary electrons) to be emitted in the channels for each of the R, G and B fluorescent cells are independently and separately (or individually) controlled. On the basis of the control of the multiplication of the secondary electrons to be emitted in each type of channel for the R, G and B fluorescent cells, an electron current to be supplied to each of the R, G and B fluorescent cells is independently and separately (or individually) controlled, so that the electron current to be applied to each of the R, G and B fluorescent cells is independently and separately (or individually) controlled in accordance with the kind of the fluorescent cells (materials) and a color tone (gradation) of an image to be reproduced. In this case, the electrodes serving as the electron acceleration control means may be designed as shown in FIG. 6 or 7 in accordance with the arrangement of the fluorescent cells, or may be designed in any form such as a flat plate. That is, the shape of the electron acceleration control means is not limited to those as shown in FIGS. 6 and 7. Further, it is not necessary to independently and separately (or individually) control the voltages to be applied to the electrodes for the R, G and B fluorescent cells.

In the above-described embodiments, a single light-emitting device such as a semiconductor laser is used to emit an image light. In place of the light-emitting device as shown in FIG. 1, plural light-emitting devices for emitting different color image lights from one another may be used as shown in FIG. 8.

Figure 8:
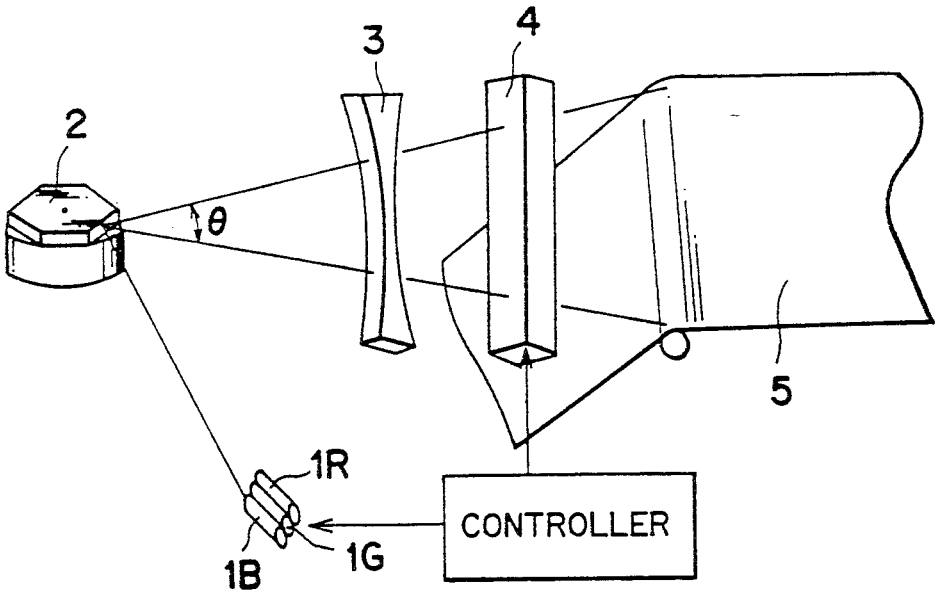
FIG. 8 is a schematic view showing an overall arrangement of another embodiment of an image forming apparatus according to the present invention.

FIG. 8 shows the overall arrangement of another embodiment of the image forming apparatus according to this invention. In the apparatus as shown in FIG. 8, the same elements as shown in FIG. 1 are represented by the same reference numerals and the description thereof is eliminated.

In this apparatus are provided three types of light emitting devices 1R, 1G and 1B comprising semiconductor lasers or the like which simultaneously or sequentially emit respective color (R, G and B) image lights in accordance with color information of an original full color image (red color image information, green color image information and blue color image information which have been obtained through a color separation process of the original full color image.

The construction and operation of the image forming apparatus of this embodiment are substantially the same as those of the first embodiment as shown in FIG. 1, except for the positional relationship between the channels and the fluorescent cells.

Figure 9:
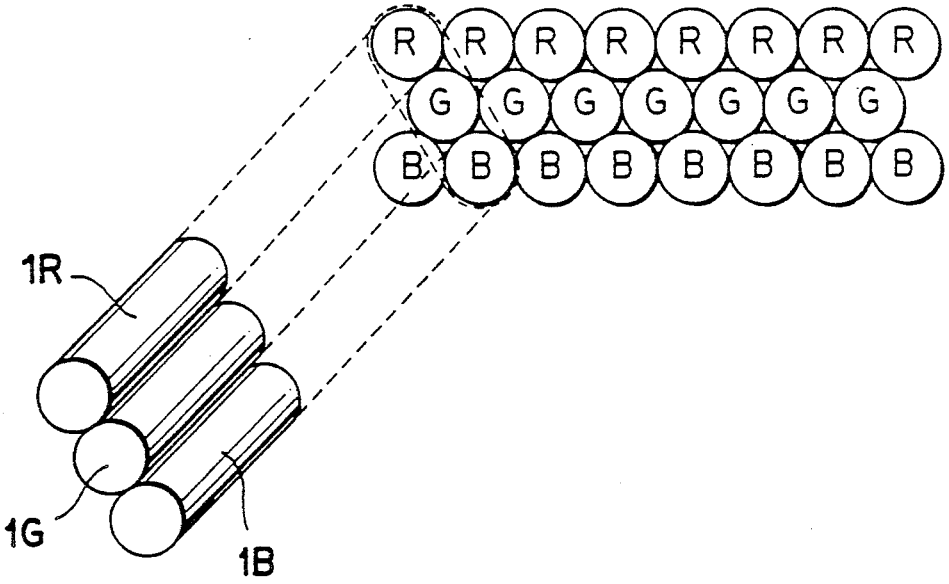
FIG. 9 is a schematic view showing the positional relationship between the light emitting elements lR, lG, lB and the fluorescent cells used in the image forming apparatus as shown in FIG. 8.

Each of the channel clusters 103 corresponds to each of the fluorescent cells as shown in FIG. 3 like the first embodiment, however, unlike the first embodiment, a beam spot of each of the light-emitting units 1R, 1G, 1B corresponds to each of the channel clusters 103, that is, corresponds to each of the fluorescent cells in one-to-one correspondence as shown in FIG. 9.

As described above, in this embodiment, the R, G and B color image lights are simultaneously produced in accordance with the original color image information by the light-emitting devices to simultaneously supply these color image lights to the R, G and B fluorescent cells, so that at least three lines on the photosensitive recording medium can be scanned at a time with the R, G and B color image lights, particularly when the strip arrangement as shown in FIG. 5 is adopted for the fluorescent cells. Therefore, a scanning speed, that is, an image forming speed is higher.

With the image forming apparatus according to the above embodiments, an image light emitted from the light-emitting means is photoelectrically converted into photoelectrons and then converted into secondary electrons with multiplication to enable the fluorescent panel to emit an intensified color image light. Since the image light emitted from the light-emitting device is once converted into a corresponding electrical signal with electrical multiplication by means of the channels for multiplying the secondary electrons and then the electrical signal is reproduced into an intensified color image light, the intensity (output power) of the image light can be increased without enlarging the diameter of a beam spot of the image light itself, so that a color image having sharp edges can be produced with high image quality.

Further, since the electrodes serving as the electron acceleration control means and/or the secondary electron multiplication control means are independently and separately (or individually) assigned to each type of the R, G and B fluorescent cells, so that light emission brightness of each of the respective types of R, G and B fluorescent cells is independently and separately (or individually) controlled and a color tone (gradation) of the color image can be continuously adjusted.

Still further, since the color image lights which are simultaneously produced and emitted from the plural light-emitting devices in accordance with the color information of the original color image are simultaneously applied to the photoelectric transducer surfaces corresponding to the plural types of fluorescent cells, an image forming speed is much higher in comparison with a case where light is emitted from one type of fluorescent cells and applied to the photosensitive recording medium. When there is used a photosensitive recording medium which is coated with coloring materials having sensitivities to the wavelengths of lights emitted from the R, G and B fluorescent cells, an image forming energy is efficiently given for exposing the photosensitive recording medium to the light and an energy efficiency is increased.

Still further, since semiconductor lasers of short wavelengths are not required for the exposure process, the apparatus can be manufactured at low cost and in compact size.

In the embodiments as described above, the light image is formed on the basis of the original image information by the light-emitting device such as a semiconductor laser, and then the thus formed light image produces the secondary electrons representing the original image in the light intensifier unit 4 while the original image information is kept. However, in this invention, means for producing the secondary electrons is not limited to the light-emitting device as described above, For example, the secondary electrons may be produced by thermoelectrons having the original image information.

Figure 10:
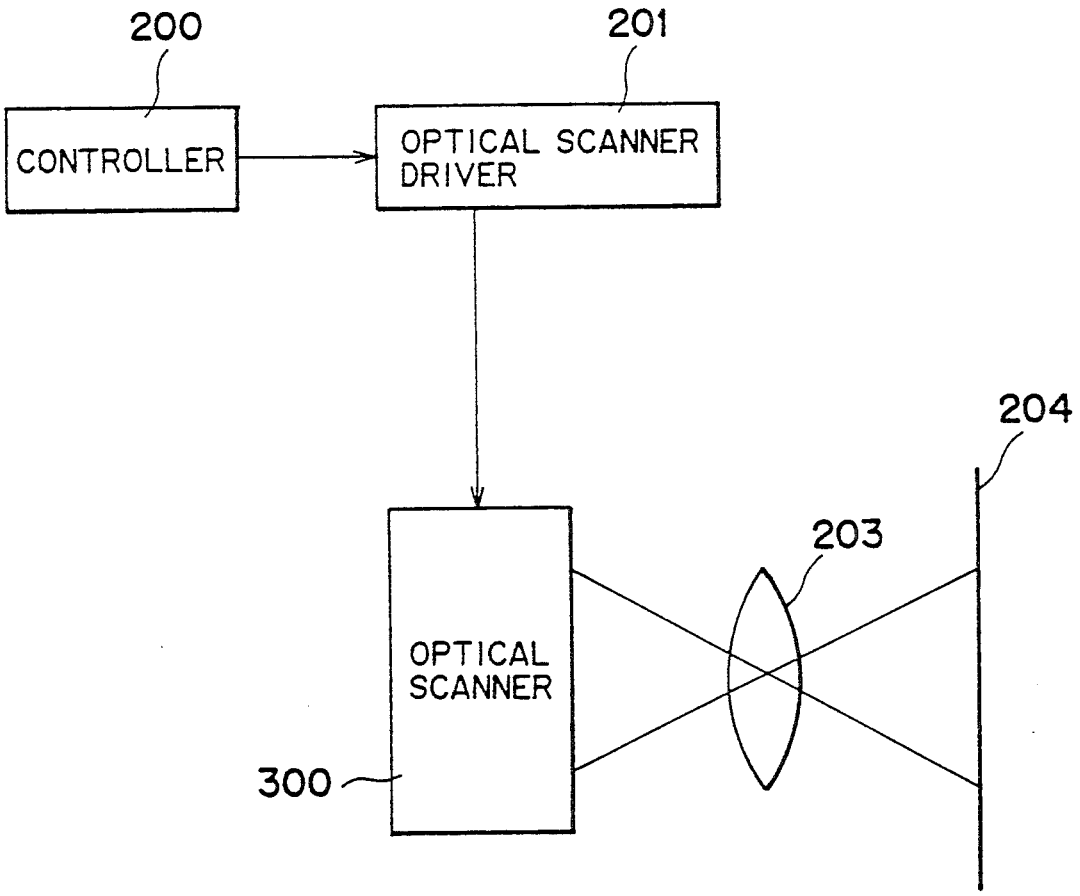
FIG. 10 is a schematic view of another embodiment of the image forming apparatus according to this invention.

FIG. 10 is a block diagram for showing the arrangement of another embodiment of the image forming apparatus.

As shown in FIG. 10, the image forming apparatus has an optical scanner 300 disposed in confronting relation to a photosensitive recording medium 204 with an optical lens 203 interposed therebetween. To the optical scanner 300 is connected to a scanner driver 201 for driving the optical scanner 300, and the scanner driver 201 is connected to a controller 200 for controlling the scanner driver 201. The photosensitive recording medium 204 used herein is assumed to be a monochromatic photosensitive recording medium which has a spectral sensitivity (photosensitivity) in a specific wavelength range. The optical scanner 300 corresponds to the light intensifier unit 4 of the first embodiment, and the optical scanner driver 201 corresponds to the light-emitting device and the light deflecting unit of the first embodiment.

Figure 11:
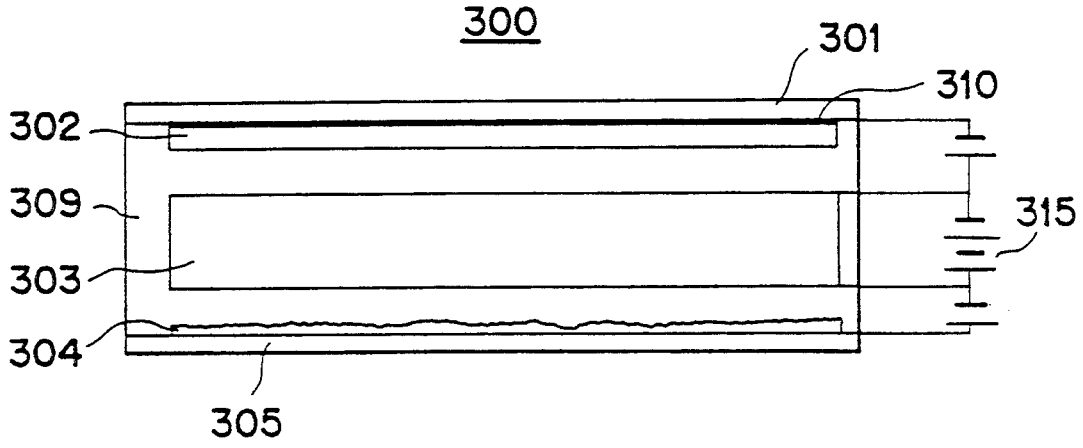
FIG. 11 is a cross-sectional view of an optical scanner of the image forming apparatus shown in FIG. 10.

FIGS. 11 through 15 show the internal structure of the optical scanner 300. As shown in FIG. 11, the optical scanner 300 has an evacuated airtight housing comprising a bottom plate 301, a glass plate 305 and a frame plate 309, which defines a closed space therein. Unlike the first embodiment, a thermal head 310 serving as heating means for producing secondary electrons in accordance with an image information is provided on the inner bottom surface of the optical scanner 300.

Figure 12:
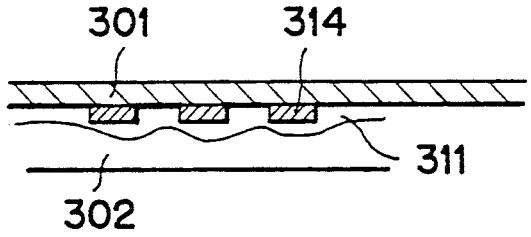
FIG. 12 is an enlarged cross-sectional view of a thermal head used in the optical scanner as shown in FIG. 11.

The detailed structure of the thermal head 310 is fragmentarily shown in FIG. 12 at an enlarged scale. The thermal head 310 comprises a number of heating elements 314 which are longitudinally and transversely (two-dimensionally) arrayed at small intervals, an insulating layer 311 covering the heating elements 314 and a hot-cathode layer 302 disposed over the insulating layer 311. The hot-cathode layer 302 is formed of amorphous or crystalline material such as barium oxide (BaO), strontium oxide (SrO) or the like.

The inner surface of the glass plate 305 is coated with finely-granular fluorescent material to form a fluorescent element surface 304 serving as fluorescent means. The fluorescent material used in the optical scanner 300 emits an image light having a wavelength which belongs to a photosensitive wavelength range of the photosensitive recording medium 204 when supplied with an energy. For example, if the photosensitive recording medium 204 has a photosensitive wavelength range of 400 to 500 nm, then the fluorescent material may be a fluorescent substance emitting a blue light (RMA number P47). If the photosensitive recording medium 204 has a photosensitive wavelength range of 500 to 600 nm, then the fluorescent material may be a fluorescent substance emitting a green light (RMA number P24).

Figure 13:
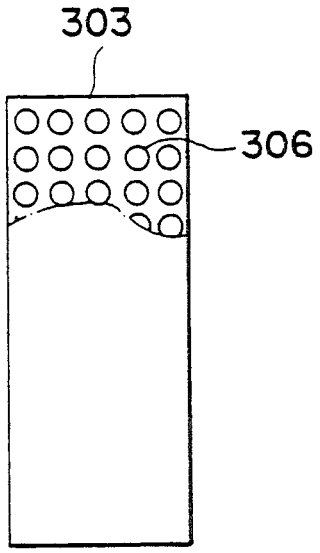
FIG. 13 is a schematic view illustrative of a multichannel plate used in the optical scanner as shown in FIG. 11.
Figure 14:
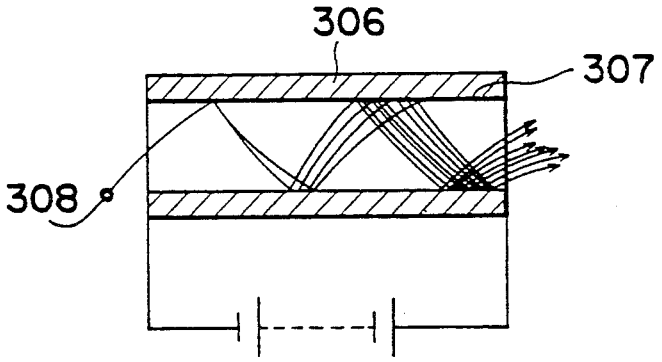
FIG. 14 is a schematic diagram for showing a multiplying process of the secondary electrons in the multichannel plate.

The optical scanner 300 further includes a multichannel plate 303 serving as an electron-multiplier is provided in the inner evacuated space of the optical scanner 300. The multichannel plate 303 comprises a number of multiplier channels 306 (a channeltron which are longitudinally and transversely (two-dimensionally) arranged as shown in FIG. 13. The multichannel plate 303 is disposed in the optical scanner 300 so as to confront the heating elements 314 and each of the channels 306 has a diameter of about 10 micrometers. Each of the channels 306 has an inner wall surface provided with a secondary electron emission layer 307 as shown in FIG. 14, and the operation thereof is substantially the same as the microchannel plate as shown in FIG. 3. A voltage supply source 315 for accelerating secondary electrons produced in each channel is connected between the inlet and outlet sides of each channel 306 as shown in FIG. 11. The outlet sides of the channels 306 face the fluorescent element surface 304. Furthermore, as shown in FIG. 11, two voltage supply sources are connected between the thermal head 310 and the multichannel plate 303 and between the multichannel plate 303 and the fluorescent element surface 304, respectively, to accelerate thermoelectrons discharged from the thermal head 310 and secondary electrons discharged from the multichannel plates 303.

An operation of the image forming apparatus thus constructed will be described hereunder.

Some heating elements 314 of the thermal head 310 are selectively energized on the basis of an image forming information such as an or original image information or a printing information, so that the hot-cathode layer 302 disposed near to the heating elements 314 is heated. When heated to a temperature of about 1000 K, thermoelectrons are emitted as primary electrons from a heated region of the hot-cathode layer 302. The emitted thermoelectrons are applied to corresponding multiplier channels (channeltrons) 306 of the multichannel plate 303 and impinge upon the secondary electron emission layer 307 on the inner wall of each channel 306, so that secondary electrons are produced while an energy is transferred from the thermoelectrons to the secondary electrons. The secondary electrons thus produced are multiplied in the channels 306 while repeatedly impinging upon the secondary electron emission layer 307. As a result, the secondary electrons are multiplied one hundred thousand times as a final gain. The secondary electrons discharged from the microchannel plate 303 are accelerated by the applied voltage and then impinge upon a prescribed area on the fluorescent element surface 304. The fluorescent element surface 304 upon which the secondary electrons impinge emits light. Since the fluorescent material is selected such that the wavelength of the light emitted from the fluorescent element surface 304 matches with the photosensitive wavelength range cf the photosensitive recording medium 204. When the light emitted from the fluorescent element surface 304 is applied though the optical lens unit 203 to the prescribed area on the photosensitive recording medium 204, the original image (printing) information is recorded on the irradiated area on the photosensitive recording medium 204.

Figure 15:
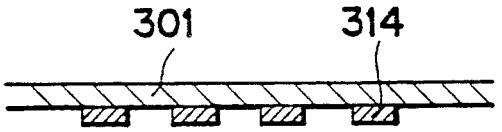
FIG. 15 is a schematic view of another embodiment of the thermal head.

Any modification may be made to the thermal head 310 serving as the heating means. For example, a thermal head having the construction as shown in FIG. 15 may be used. In this thermal head, the heating elements 314 may be composed of a material such as tungsten (W) or thorium-tungsten (Th-W) which has a thermal-conductive property and a thermoelectron emission capability. Thermoelectrons can be emitted at about 2700 K from the heating elements of tungsten (W), and at about 1900 K in the heating elements of thorium-tungsten (Th-W).

It is preferable for miniaturization of the image forming apparatus to use an optical lens 203 such as a rod lens array having a short focal point. However, it is possible to keep the optical scanner and the photosensitive recording medium in fully intimate contact with each other for an exposure process. After the exposure process, a latent image on the photosensitive recording medium 204 is developed by a developing process for the photosensitive recording medium to form a visible image such as a picture, letters, characters and so on.

As described above, in the image forming apparatus of the above embodiment, the thermoelectrons having an image information are produced on the basis of an original image information or the like, and :hen is converted into secondary electrons representing the image information with multiplication. Thereafter, the multiplied secondary electrons are accelerated up to a higher energy level and supplied to the fluorescent element surface formed of the fluorescent material which emits light having high output power. The light emitted from the fluorescent element surface is applied to the photosensitive recording medium while the image information is kept. In this case, the fluorescent material of the fluorescent element surface is selected so as to match with the photosensitive characteristic of the photosensitive recording medium. Therefore, letters having sharp edges can be formed on the photosensitive recording medium, particularly when the letters are recorded on the photosensitive recording medium. As an image forming energy is efficiently given for the exposure of the photosensitive recording medium the energy efficiency is increased. Further, since a semiconductor laser which is expensive in cost is not required, the apparatus can be manufactured at low cost and miniaturized in size, like the first embodiment.

In the above embodiment, the photosensitive recording medium 204 monochromatic which has a specific photosensitive wavelength range. Therefore, a reproduced image or letter is monochromatic. However, like the first embodiment, this embodiment may be applied to a color image forming process. In this case, three kinds of color fluorescent materials for emitting R, G and B color lights are provided on the glass plate 305 in a dot, strip, delta or other patterns, for example, as shown in FIG. 3 or 5. Of course, three groups of the heating elements of the heating means are assigned to the R, G and B fluorescent materials, respectively, and are independently supplied with R, G and B color informations of the original image to simultaneously emits three types of thermoelectrons representing the R, G and B color informations to the R, G and B fluorescent materials, respectively. Therefore, a color image is formed on the photosensitive recording medium at high speed.

The above embodiments are described particularly when a color or monochromatic image is recorded on a photosensitive recording medium. However, the subject matter of this invention is not limited to this field. For example, this invention may be applied to an image display. In this case, the fluorescent plate 42 of the first embodiment as shown in FIG. 2 or the fluorescent material surface 304 is used as a screen of the display. Of course, the photosensitive recording medium or the like is not required in this display.

An operation of the display in which the optical scanner 300 as shown in FIG. 10 is typically adapted will be representatively described hereunder, particularly when a color displaying operation is carried out.

Thermoelectrons which are produced on the basis of an image forming information by the heating means are converted into secondary electrons, and the secondary electrons are multiplied and accelerated up to a higher energy level in the microchannel plate 303. The accelerated secondary electrons impinge upon the fluorescent element surface 304 serving as a screen to emit a color image light having high output power. By selecting fluorescent materials for the fluorescent element surface 304 which emit red, green and blue color lights, respectively and by suitably arranging the fluorescent materials (for example, as shown in FIG. 6 or 7), an extremely-thin display unit for forming a color image with high image quality can be provided. Accordingly, in such a display, a large-scaled display can be made without increasing volume, cost and size thereof.

In the embodiments as described above, the image forming apparatus and the display are described representatively using one dimensional configuration thereof. However, a two-dimensional arrangement of the fluorescent cells, a two-dimensional scanning operation of the optical scanning driver and the electrodes which are operable in a matrix, can be provided to two-dimensionally display a color image on the screen. In a case where the electrodes are two-dimensionally arranged (in column and row directions), the secondary electrons or thermoelectrons are emitted at an electrode positioned at the intersection between the column and row directions. With such an arrangement, a two dimensional image forming apparatus and display can be easily provided.

What is claimed is:

1. An image forming apparatus for irradiating an image light on a photosensitive recording medium having at least one photosensitive wavelength range on the basis of an image information to thereby form an image on the photosensitive recording medium, comprising:

primary electron emitting means responsive to light of a first wavelength for emitting a primary electron signal having the image information;

secondary electron emitting/multiplying means for converting the primary electron signal into secondary electrons and multiplying the secondary electrons;

fluorescent light emitting means for converting the multiplied secondary electrons into fluorescent light having a second wavelength in the photosensitive wavelength range of the photosensitive recording medium and irradiating the fluorescent light onto the photosensitive recording medium, thereby forming an image on the photosensitive recording medium;

means for feeding said photosensitive recording medium in a predetermined direction and exposing it to said fluorescent light, to develop thereby a latent image on said photosensitive recording medium; and means for developing said latent image on said recording medium.

2. An image forming apparatus as claimed in claim 1, further comprising acceleration means for accelerating the secondary electrons produced in said secondary electron emitting/multiplying means and emitting the accelerated secondary electrons therefrom to said fluorescent light emitting means.

3. An image forming apparatus as claimed in claim 2, further comprising acceleration control means for controlling the acceleration of the secondary electrons accelerated by said acceleration means.

4. An image forming apparatus as claimed in claim 1, wherein said primary electron emitting means comprises light-emitting means for emitting the image light on the basis of the image forming information, and photoelectric transducing means for converting the image light into photoelectrons as primary electron, and wherein said secondary electron emitting/multiplying means includes multiplying means for producing the secondary electrons from the photoelectrons with multiplication.

5. An image forming apparatus as claimed in claim 4, wherein said multiplying means comprises a microchannel plate.

6. An image forming apparatus for irradiating an image light on a photosensitive recording medium having at least one photosensitive wavelength range on the basis of an image information to thereby form an image on the photosensitive recording medium, comprising:

thermoelectron emitting means for emitting thermoelectrons as a primary electron signal representing the image information;

secondary electron emitting/multiplying means for converting the primary electron signal into secondary electrons and multiplying the secondary electrons; and fluorescent light emitting means for converting the multiplied secondary electrons into fluorescent light having a wavelength in the photosensitive wavelength range of the photosensitive recording medium and irradiating the fluorescent light onto the photosensitive recording medium, thereby forming an image on the photosensitive recording medium.

7. An image forming apparatus as claimed in claim 6, wherein said thermoelectron emitting means comprises a thermal head having plural heating elements being energized in accordance with the image information, an insulating layer and a thermal cathode layer for emitting thermoelectrons in accordance with supply of heat thereto from said thermal head.

8. An image forming apparatus as claimed in claim 7, wherein said thermal cathode layer is formed of any material selected from the group consisting of barium oxide and strontium oxide.

9. An image forming apparatus as claimed in claim 6, wherein said thermoelectron emitting means comprises a thermal head of plural heating elements each having thermal-conductivity and thermoelectron emission capability, said heating elements being energized in accordance with the image information to emit thermoelectrons representing the image information.

10. An image forming apparatus as claimed in claim 9, wherein each of said heating elements is formed of any material selected from the group consisting of tungsten and thorium-tungsten.

11. An image forming apparatus as claimed in claim 7, wherein said secondary electron emitting/multiplying means comprises a multichannel plate provided in such a manner as to confront said heating elements.

12. An image forming apparatus for irradiating a color image light on a photosensitive recording medium having plural photosensitive wavelength ranges on the basis of a color image information to thereby form a color image on the photosensitive recording medium, comprising:

primary electron emitting means for emitting a primary electron signal spacedly encoded according to a plurality of colors of the color image information, the primary electron emitting means being responsive to corresponding spacedly dispersed incident light of at least one first wavelength;

secondary electron emitting/multiplying means for converting the primary electron signal in to secondary electrons and multiplying the secondary electrons; and fluorescent light emitting means for converting the multiplied secondary electrons into red, green and blue color image lights having second wavelengths matching with the photosensitive wavelength ranges of the photosensitive recording medium and irradiating the color image lights onto the photosensitive recording medium, thereby forming a color image on the photosensitive recording medium.

13. An image forming apparatus as claimed in claim 12, wherein said fluorescent light emitting means comprises a fluorescent panel coated regularly with three kinds of fluorescent cells encapsulating fluorescent materials for emitting red, green and blue lights, respectively.

14. An image forming apparatus for irradiating a color image light on a photosensitive recording medium having plural photosensitive wavelength ranges on the basis of a color image information to thereby form a color image on the photosensitive recording medium, comprising:

primary electron emitting means for emitting a primary electron signal having the color image information;

secondary electron emitting/multiplying means for converting the primary electron signal into secondary electrons and multiplying the secondary electrons;

fluorescent light emitting means for converting the multiplied secondary electrons into red, green and blue color image lights having wavelengths matching with the photosensitive wavelength ranges of the photosensitive recording medium and irradiating the color image lights onto the photosensitive recording medium, thereby forming a color image on the photosensitive recording medium, said fluorescent light emitting means comprising a fluorescent panel coated regularly with three kinds of fluorescent cells encapsulating fluorescent materials for emitting red, green and blue lights, respectively; and color tone control means for individually controlling brightness of each light emitted from each of said three kinds of fluorescent cells to adjust a color tone of the color image.

15. An image forming apparatus as claimed in claim 14, wherein said color tone control means comprises acceleration control means provided on said fluorescent light emitting means for individually controlling acceleration of the secondary electrons to be supplied from said secondary electron emitting/multiplying means to each of said three kinds of fluorescent cells.

16. An image forming apparatus as claimed in claim 15, wherein said acceleration control means comprises three types of electrodes, each type of electrodes being assigned to each of said three kinds of fluorescent cells, and variable-voltage supply sources for applying variable voltages for accelerating the secondary electrons to said electrodes.

17. An image forming apparatus as claimed in claim 14, wherein said color tone control means comprises multiplication control means provided on said secondary electron emitting/multiplying means for individually controlling a multiplying ratio of the secondary electrons to be produced in said secondary electron emitting/multiplying means and supplied to each of sad three kinds of fluorescent cells.

18. An image forming apparatus as claimed in claim 17, wherein said multiplication control means comprises three types of electrodes, each type being assigned to each of said three kinds of fluorescent cells, and variable-voltage supply sources for applying variable voltages for multiplying the secondary electrons to said electrodes.

19. An image forming apparatus as claimed in claim 13, wherein said three kinds of fluorescent cells are arranged on said plate in such a manner that different kinds of fluorescent cells are assembled in one of a triangular form for every three cells and aligned in a stripe form while the same kind of fluorescent cells are aligned with one another.

20. An image display for displaying a color image on a screen on the basis of an image information comprising:

thermoelectron emitting means for emitting thermoelectrons as a primary electron signal having the image information;

secondary electron emitting/multiplying means for converting the primary electron signal into secondary electrons and multiplying the secondary electrons;

fluorescent light emitting means having a fluorescent screen for converting the multiplied secondary electrons into red, green and blue color image lights, thereby displaying a color image on the screen;

means for feeding said photosensitive recording medium in a predetermined direction and exposing it to said fluorescent light, to develop thereby a latent image on said photosensitive recording medium; and means for developing said latent image on said recording medium.

21. An image display as claimed in claim 20, wherein said fluorescent light emitting means comprises a fluorescent panel coated regularly with three kinds of fluorescent cells encapsulating fluorescent materials for emitting red, green and blue lights, respectively.

22. An image display as claimed in claim 21, further comprising color tone control means for individually controlling brightness of each light emitted from each of said three kinds of fluorescent cells to adjust a color tone of the color image.

23. An image display as claimed in claim 22, wherein said color tone control means comprises acceleration control means provided on said fluorescent light emitting means for individually controlling acceleration of the secondary electrons to be supplied from said secondary electron emitting/multiplying means to each of said three kinds of fluorescent cells.

24. An image display as claimed in claim 23, wherein said acceleration control means comprises three types of electrodes, each type of electrodes being assigned to each of said three kinds of fluorescent cells, and variable-voltage supply sources for applying variable voltages for accelerating the secondary electrons to said electrodes.

25. An image display as claimed in claim 22, wherein said color tone control means comprises multiplication control means provided on said secondary electron emitting/multiplying means for individually controlling a multiplying ration of the secondary electrons to be produce in said secondary electron emitting/multiplying means and supplied to each of said three kinds of fluorescent cells.

26. An image display as claimed in claim 25, wherein said multiplication control means comprises three types of electrodes, each type being assigned to each of said three kinds of fluorescent cells, and variable-voltage supply sources for applying variable voltages for multiplying the secondary electrons to said electrodes.

27. An image display as claimed in claim 21, wherein said three kinds of fluorescent cells are arranged on said plate in such a manner that different kinds of fluorescent cells are assembled in one of a triangular form every three cells and aligned in a stripe form while the same kind of fluorescent cells are aligned with one another.

* * * * *